US005384156A

United States Patent [19]

Belt et al.

[11] Patent Number: 5,384,156

[45] Date of Patent: Jan. 24, 1995

[54] REVERSIBLE METHOD OF MAGNETIC FILM ANNEALING

[75] Inventors: Roger F. Belt, Morris Township, Morris County; John B. Ings, Rockaway Township, Morris County, both of N.J.

[73] Assignee: Litton Systems, Inc., Morris Plains, N.J.

[21] Appl. No.: 110,785

[22] Filed: Aug. 23, 1993

[51] Int. Cl.[6] ..... H01F 10/02

[52] U.S. Cl. ..... 427/127; 427/128; 427/129; 427/130; 427/162; 428/900

[58] Field of Search ..... 427/128–132, 427/162; 428/900, 928

[56] References Cited

U.S. PATENT DOCUMENTS 3,759,745 9/1973 Dixon et al. ..... 427/130

OTHER PUBLICATIONS

J. P. Krumme et al., J. Appl. Phys. 48, 5191 (Dec. 1977).
R. F. Belt, J. Appl. Phys. 70, 6398 (Nov. 1991).
R. Metselaar et al., J. Phys. Chem. Solids 34, 2257 (1973) (no month avail.).
R. Kappelt et al., SPIE vol. 274, p. 169 (1990) (no month avail).
G. R. Pulliam et al., J. Appl. Phys. 53, 2754 (Mar. 1982).
R. F. Belt et al., SPIE vol. 753, 142 (1987)(no month available).
R. M. Josephs, Proceedings of the AIP 18th Annual Conference on Magnetism and Magnetic Materials, 1972, pp. 283–303 (no month avail.).
P. Hansen et al., J. Appl. Phys. 43, 4740 (Nov.1972).
C. Jovanic, et al., J. Appl. Phys. 71 436 (Jan. 1992).
R. Wolfe, et al., Appl. Phys. LeH. 46, 817 (1985) (no month avail).
F. K. Lotgering, J. Phyrs. Chem. Solids 36, 1183 (1975)(no month avail.).
E. Milani et al., J. Appl. Phys. 5, 2173 (Mar. 1984).
G. Balestrino et al., J. Sppl. Phys. 59, 424 (1986)(no month avail.).

*Primary Examiner*—Bernard Pianalto
*Attorney, Agent, or Firm*—Michael H. Wallach

[57] ABSTRACT

A method is described for adjusting magnetic properties of iron-containing magnetic films. The coercivity of magneto-optic films such as bismuth garnet films is adjusted by an annealing method which comprises reduction with a reducing agent such as $H_2$ followed by oxidation using an oxidizing agent such as $O_2$ and/or $O_3$ to adjust to required coercivity levels with the sequence of reduction followed by oxidation repeated one or more times to obtain required coercivity. It is also an aspect of the invention to precede the first reducing treatment with an oxygen annealing step to enhance uniformity of the switching field.

16 Claims, No Drawings

REVERSIBLE METHOD OF MAGNETIC FILM ANNEALING

BACKGROUND OF THE INVENTION

1. Field of the Invention

The present invention relates to a reversible method of annealing magnetic films.

2. Description of the Prior Art

Magneto-optic films and/or various devices utilizing same have been described in the following patents, the teaching of which is incorporated herein by reference thereto: U.S. Pat. Nos. 4,497,545; 4,500,176 and 4,500,177, directed to spatial light modulators. U.S. Pat. Nos. 4,625,167 and 4,755,752, directed to crack detection devices; U.S. Pat. No. 4,728,178, directed to switches, modulators; U.S. Pat. No. 4,604,577, directed to magnetic field sensors; and, U.S. Pat. Nos. 3,838,450; 3,989,352 and 4,608,742, directed to memory and recording/modulator devices. Magneto-optic films have also been used in optical isolators, see e.g., *Fujitsu Science & Tech. Journal,* Vol. 26, No. 26. Such films may also find utility in rotation sensors for brakes.

Small changes of 1–5 Oe in dynamic Hc were measured by Metselaar and Huyberts, *J. Phys. Chem. Solids* 34, 2257 (1973), in YIG single crystals and polycrystals. The likely defects were oxygen vacancies. Lotgering, *J. Phys. Chem. Solids* 36, 1183 (1975), investigated permeability ($\mu$) changes in Co or Si doped YIG polycrystals and developed a model of domain wall pinning by anisotropic ions. Dixon and Kurtzig, U.S. Pat. No. 3,759,745 (1973), reported changes in $4\pi Ms$ with $H_2$ treatments of bubble films. Milani and Paroli, *J. Appl. Phys.* 55, 2173 (1984), studied specifically the $H_2$ diffusion in bulk YIG and films but only reported on optical properties. A later paper by G. Balestrino, S. Lagomarsino and A. Tucciarone, *J. Appl. Phys.* 59, 424 (1986), described X-ray lattice constant expansions and contractions with $H_2$ annealed YIG films. A more recent effort by Kappelt et al., *SPIE* Vol 274, p. 169 (1990), measured only optical anisotropy changes in epitaxially grown films treated with $H_2$.

3. The Present Invention

Single crystal bismuth containing garnet films are used in modulators, optical isolators, microwave devices and sensors. The high perfection of these films, however, normally results in such films possessing low (<0.5Oe) as grown coercivity (Hc). As described in U.S. patent application Ser. No. 07/789,362, filed Nov. 8, 1991, the disclosure of which is incorporated herein by reference thereto, the introduction of controlled numbers, sizes and distribution of defects serves to increase coercivity and generate a nearly square hysteresis loop, such features offering favorable effects in switching devices. In accordance with the present invention, the coercivity of magneto-optic films such as bismuth garnet films is adjusted by an annealing method which comprises reduction with a reducing agent such as $H_2$ followed by oxidation using an oxidizing agent such as $O_2$ and/or $O_3$ to adjust to required coercivity levels with the sequence of reduction followed by oxidation repeated one or more times to obtain required coercivity. It is also an aspect of the present invention to precede the first reducing treatment with an oxygen annealing step to enhance uniformity of the switching field.

Oxygen anneal to adjust for coercivity is difficult to control and the yield of acceptable wafers is low. The method of the present invention produces an oxygen annealed magnetic film for the first time, wherein the results of excessive oxygen anneal can be reversed, moreover, the present invention allows oxidation anneal to be performed at lower temperature levels, further improving film yield by not only allowing recovery of over-annealed film, but also limiting film failure. In other words, by preceding anneal at oxidation conditions with anneal at reducing conditions the elevated temperatures generally required for oxygen anneal are no longer required and the irreversibility of excess oxygen anneal is eliminated.

SUMMARY OF THE INVENTION

The present invention occurred when it was discovered that annealing of a highly sensitive magneto-optic Tm—Bi based film, namely, bismuth, thulium, gallium, garnet, (which was being annealed in an oxidizing atmosphere using high temperature anneal at about 1050° C.) could be facilitated by annealing in a hydrogen atmosphere before annealing in an oxidizing atmosphere.

It was discovered that by preceding oxygen annealing with hydrogen anneal, several benefits are achieved, namely:

- oxygen anneal (subsequent reoxidation) can be performed at substantially lower temperature levels (temperatures of about 600° C. were in fact found optimal)
  - (i) oxygen annealing in accordance with the present invention became easier to perform and control and fewer wafers broke from thermal stress;
- the effects of oxidizing anneal are reversed by retreatment with a reducing agent such as hydrogen
  - (i) repeating the reducing agent treatment after oxidizing anneal permits films of inadequate uniformity of switching field and/or overshot sensitivity—contrast balance to be recovered and retreated in a new sequence of $H_2$ reduction and then $O_2$ oxidation treatment to achieve the required film properties;
- the films produced in accordance with the present invention retain better contrast at elevated temperatures than the films treated only by oxidation annealing.

Moreover, whereas as-grown films or those processed with just oxidizing anneal can develop fine domain structure at higher temperatures which impair performance of such films in crackdetection devices, the hydrogen pretreated films do not have this problem.

Significantly and inexplicably, it has been observed that hydrogen pretreated/annealed films rotate polarized light in a direction for a given magnetization that is opposite that of as-grown or oxidized-only (oxidation annealed only) films.

In its broadest aspects, the method of the present invention is applicable to any iron-containing magnetic materials, particularly in single or polycrystalline form. The present method can be used in the treatment of rare earth iron magnets and intermetallic magneto-optic materials.

The advantages of the process of the present invention are of particular importance where the magnetic material is an oxide magnetic material, such oxide magnetic material being exemplified by garnets, orthoferrites and other oxides of spinel type structures. This is because the dominant magnetic ion is the $Fe^{3+}$ while small amounts of $Fe^{2+}$, or $Fe^{4+}$ can be present due to the chemical preparation conditions. It is believed that the reduction/re-oxidation process achieves the desired property modifications through a change in valence state of one or more constituent ions such as iron. The process is also directed towards magnetic or magneto-optic materials which are formed from two or more metals (valence—0) one of which is a transition metal or a rare earth metal. Examples of such materials are TbFe, Co alloys, Tb Fe, Gd Fe, Gd Co, Gd Tb Co, Nd Co and others which are useful for magneto-optic recording materials in the form of thin films. Thin film inductive recording heads, permanent magnets, particulate recording media, soft magnets, and microwave magnets and other areas of magnetism where properties may be changed by the combined oxidation—reduction process. The process of the present invention works to greatest advantage on single crystals or polycrystalline films because the method influences the coercivity more than saturation magnetization.

As heretofore noted, the method of the present invention finds particular applicability in the treatment of single crystal magnetic oxides such as spinels, garnets and orthoferrites. Examples of single crystal iron-containing garnets benefited by treatment in accordance with the present invention are the rare earth iron garnets, transition element containing iron garnets, bismuth iron containing garnets and the like.

Among the films that benefit from treatment in accordance with the present invention are films defined by the following generic formula:

$$Bi_xRE_{3-x}Fe_{5-y}Ga_yO_{12}$$

where RE represents a rare earth, or combination of rare earths or Y or combination of Y with one or more rare earths; x=0 to 3 and y is greater than zero and less than five.

Among the suitable substrates for such films are the following garnets:

| | |
|---|---|
| GGG | a = 12.383Å |
| CMZGGG | a = 12.495Å |
| YSGG | a = 12.452Å |
| GSGG | a = 12.550Å |
| NdGGG | a = 12.510Å |
| LaLuG | a = 12.61Å |
| SmSGG | a = 12.69Å |
| SMGG | a = 12.438Å |

As a practical matter, the method works best with films of less than about 20 micron thickness, preferably less than 10 microns in thickness and most preferably 3±2 microns. For magneto-optic films of the type finding utility in magneto-optic devices film thicknesses of from about 2 to 3.5 microns have been found optimal.

The reduction anneal step requires a fluid reducing agent that extracts oxygen from the film at anneal conditions. Suitable reducing agents in the reducing anneal step are those which have a reduction potential to reduce ferric to ferrous. The reducing agent must be capable of migration below the film surface or of generating a migrating species such as oxygen vacancies. Although hydrogen is preferred, other gases such as CO, $CH_4$, $C_2H_4$ and $C_2H_2$ as well as other hydrocarbons are further examples of suitable reducing agents.

Where the film being treated is bismuth iron garnet and hydrogen (15% by volume) in an inert carrier such as nitrogen is used (this level being selected to meet safety requirements), anneal temperatures greater than about 450° C. are preferred. Extended treatment is used, that is, anneal is extended over many hours, e.g. (two or more). At temperatures below 450° C., e.g., unnecessarily long annealing times are required.

More practical is treatment in the range of from about 480° to about 490° for about 10 minutes. This achieves satisfactory results. Temperatures above 520° C. are not recommended for garnet films since peeling, of film frequently occurs.

The level of reduction is readily monitored and measured through analysis of $Fe^{2+}$ ion by measuring optical absorption or magnetic resonance during treatment.

Although not wishing to be bound, it is believed that the treatment at reduction conditions prior to anneal at oxidation conditions causes formation of a "two layer" architecture within the original "single layer" film. The reduction step affects the internal architecture of the film to a greater depth than the succeeding oxidation anneal. This creates two different layers/planes within the film with Fe ions at different valence states within the layers.

The reduction step, for magneto-optic monocrystalline films, such as garnet films herein described, meeds to be conducted to a degree that darkening due to hydrogen anneal is observed. To achieve the level of reduction required in accordance with the present invention, film surface must be reduced sufficiently to reduce transparency of the film.

Oxidant used in the annealing step at oxidizing conditions is preferably an oxygen-containing oxidant that enables oxygen diffusion into the crystal structure of the film. Other oxidizing elements or compounds in fluid phase can be substituted for oxygen-containing oxidant although not necessarily with the same effect. Whatever oxidant is selected it is essential that the oxidant have a reduction potential to oxidize ferrous ions to ferric ions.

An oxygen-containing oxidizing agent in fluid phase also specifically contemplated is hydrogen peroxide solution.

The time required for oxidant anneal is dependent on partial pressure of the oxidant. Thus, where oxygen is used as oxidant the time of treatment is shortened where pure oxygen is substituted for air and further shortened where the strength of oxidant is increased, as is the case where the oxidant is ozone.

The temperature and time of the oxidation anneal step are dependent on the material being treated and degree of nonuniformity in the as grown material and/or previously treated material.

The elevated temperatures used in the oxidation anneal step extend over the broad range of from about 400° C. to about 600° C. or higher. It has been found that treatment at about 580° C. affords a high level of process control. Typical anneal time at 580° C. varies from about 20 to about 40 minutes. Anneal temperatures above 600° C. can be used by curtailing treatment time to a matter of minutes; however, such elevated temperatures are not recommended because of the difficulty in controlling anneal level because of the short time window and also because thermal uniformity of the film during anneal is difficult to achieve.

For as grown film, the optional uniformity anneal step suitably is performed at temperatures above about 400° C. for an extended period (one to two days) or more normally above about 600° C. at which temperature uniformity anneal can be achieved within a matter of hours.

The as grown film, though it may be uniform, as a rule will not have a high response to both external bias magnetic field and super added pulsed magnetic field. It is most preferred that the film treated in accordance with the reduction-oxidation process of the present invention have a variation in the hysteresis threshold of domain wall motion of less than about 0.2 oersted; and, this preferred state typically is achieved by preceding reduction-oxidation treatment with uniformity anneal.

It is believed that non-uniformity of as-grown film results from lack of stoichiometric uniformity or lack of uniform deviation from stoichiometric composition throughout the film. The uniformity anneal involves heating the film to a level where diffusive transport occurs enabling oxygen exchange of film with overlying ambient oxygen-containing gas. The uniformity anneal has, as its objective, the achievement of stoichiometric uniformity or uniform deviation from stoichiometric uniformity throughout the film. This, because stoichiometric uniformity is required for a uniform reduction reaction and subsequent uniform magnetic properties.

DETAILED DESCRIPTION OF THE INVENTION

Where the film of the present invention is produced for usage in devices for detecting cracks such as described in U.S. Pat. Nos. 4,625,167 and 4,755,752, certain film properties are desirable and their achievement enhances the operation of such devices.

In accordance with one aspect of the present invention directed to use of the film in crack detecting devices and the like, the method of the present invention is directed to the manufacture of films that can be magnetized easily in essentially single domains and which retain such magnetization when the poling field is removed and/or very slightly reversed.

This application of the present invention requires that the domain walls move easily in response to small changes in the magnetic field above a threshold field. Thus, the films to operate efficiently should possess a moderate and controlled coercivity of from about 0.1— to about 0.8 Oe. This application further requires that the switching field be highly uniform across the film. The coercivity is controlled such that switching begins with fields of between 0.1 and 0.8 Oe and is 95% complete with fields of between 2 and 3.5 Oe.

It has been found that the described requirements can be met by preceding oxidizing anneal of the film with hydrogen anneal. In addition, the first hydrogen anneal is preferably preceded by treatment of the as-grown film by first annealing same at moderately high temperatures of from about 600° C. to about 700° C. in an oxidizing environment (oxygen) to improve switching uniformity. An adequate degree of uniformity is obtained when the field required to initiate domain wall motion varies by less than about 5% across the wafer. Subsequently, the film is annealed in a reducing atmosphere, suitably a hydrogen containing atmosphere. The conditions (gas, ambient, temperature, duration) of the reduction anneal must be such that a darkened layer forms on the film This darkened layer should be sufficient to reduce the visible light transmission of the film to between about 0.5 and about 0.05 times the transmission prior to the anneal. For a given gas ambient and temperature, the required anneal duration is sensitive to the surface preparation conditions of the film. For example, 6 to 10 minutes in a 15% $H_2$, 85% $N_2$ mixture at 490° C is sufficient to induce the proper degree of darkening for an "as grown" film. However, 12 to 15 minutes of the same condition are required to induce the same degree of darkening in an "as grown" film that has been etched prior to the anneal in a 100° C. $H_2SO_4$ solution for eight minutes. Finally, the film is reoxidized just long enough so that it will operate satisfactorily in crack detection devices of the type described in U.S. Pat. Nos. 4,625,167 and 4,755,752. The condition of the re-oxidation anneal are temperatures of from about 400° to about 600° C. in a pure oxygen ambient. The lower temperature range is not preferred because the required anneal duration—ten hours or more—makes the process too slow. Temperatures above about 600° C. are not preferred because a greater degree of darkening from the reduction anneal is required. With greater darkening of the film during the reduction anneal, there is an increased likelihood that the crystalline structure of the film becomes damaged. The most preferred temperature is about 600° C. At this temperature an anneal duration of between 30 and 50 minutes is optimal.

It has been found that only a few films have functioned satisfactorily after the described three step annealing sequence. Almost all films require further treatment with hydrogen anneal and oxidizing anneal steps. It has been found that the performance of films in the crack detector is related to the size of magnetic domains and that the conditions of the re-oxidation anneal initially cause the domain size to decrease. After 30 minutes or more of re-oxidation anneal, the domain size will stop decreasing and the size begins to increase. If the domain size has not attained the preferred size of about 1 mm strip period, it is part of this process to repeat the reduction and re-oxidation cycle. Occasionally, a processed film requires repetition of the uniformity anneal because of switching non-uniformities that were either not detected initially or that were introduced as a result of previous processing (non-uniform surface preparation, epitaxial film formation, heterogeneous anneal conditions). The steps of the present invention, their sequence, the protocol and process criteria are described below.

Treatment Protocol and Process Control Criteria

Successive reducing and oxidizing treatments are applied to magnetic films to modify and achieve precise control of the switching characteristics. Prior to treatment by such reduction/re-oxidation processes, it is desirable to subject the starting material to a uniformity anneal.

The purpose of the preferred uniformity anneal is to insure that the chemical potentials of the species within the starting material, such as $[Fe^{3+}]$, $[O^{2-}]$, $[Tm^{3+}]$, and $[Bi^{3+}]$, are uniform throughout the sample. This step is preferred since as-grown material, for example material grown by liquid phase epitaxy, may have variations in the activity of the constituent chemical species. These potentials affect the susceptibility of the material to the reducing treatment. The ultimate magnetic switching characteristics of the film are highly sensitive to the extent of the chemical and physical changes that occur during the reducing treatment. Thus chemical species uniformity in the starting material, particularly with respect to oxidative potential, is required to achieve a product with a uniform switching field. We have found from experience that the performance of films in the crack detector is strongly dependent on how uniformly the film switches in response to an external magnetic field. We have also observed in developing this invention that switching non-uniformities present prior to the reduction anneal persist through the reduction and re-oxidation anneals. Since performance of the final product is strongly degraded by non-uniformity in switching and since these non-uniformities are not removed in the course of the reduction and re-oxidation anneals, they must be reduced to an acceptable level prior to the reduction/re-oxidation steps. Preferably, the uniformity anneal is repeated until the switching non-uniformities are undetectable. However, acceptable crack detector films have been produced when the switching threshold varies by less than 10% across the area of the wafer. It is difficult to detect variation in the switching threshold of less than 5% unless special apparatus are utilized.

A magnetic oxide crystal consists of one or more metal ions and oxygen atoms arranged in a particular order. The location of atoms in the crystal is described by a unit cell and lattice. The unit cell gives the relative location of atoms with respect to each other and the lattice gives the directions and distances over which the unit cell may be replicated to produce the crystal. Real crystals have small deviations from this idealized description that are called site defects. A site defect is the presence or absence of an atom or ion that differs from the unit cell plus lattice prediction. Site defects may interact structurally with other site defects (for example to form pairs or clusters) and also interact electronically with other site defects and the rest of the crystal (for example by exchanging charge or spin).

Real crystals possess widely differing types and concentrations of site defects. Even crystals of nominally the same composition but grown under slightly different conditions may possess different concentrations and types of site defects. Many important properties of magnetic oxides such as magnetocrystalline anisotropy, coercivity, electrical conductivity—to name a few—are strongly influenced by the type, concentration, and interaction of site defects.

For example, when an oxide crystal is subjected to a reducing environment, several processes will begin to occur as the crystal becomes more reduced. First, the crystal will loose oxygen atoms and generate oxygen vacancies, a type of site defect. An increase in oxygen vacancy concentration may enhance diffusion of particular ionic species within the crystal. For example, some ions may only diffuse, or change the site they occupy in a crystal, by moving into an adjacent empty oxygen site as an intermediate step. This process may be chemical species selective. That is, under the right conditions, one particular chemical species may diffuse significantly while others do not.

If the environment becomes slightly more reducing, some of the constituent ions of the crystal may change oxidation number, generating significant amounts of another chemical species. This species may favor occupancy of a crystal site that is different from the precursor species. By this mechanism, significant concentrations and possibly specific types of site defects may be generated. These changes will also generate stress within the crystal. The stress will be oriented with respect to the exposed crystal surface. This stress may influence the type of site defects subsequently formed, the diffusion of site defects, the diffusion of constituent species, and the structural interaction of site defects.

As the material reacts further in a reducing environment that is sufficiently strong, the crystalline structure will become disrupted. Oxygen vacancy clusters may coalesce into voids, significant concentrations of new chemical species may cause new crystalline structures to nucleate and grow and the material may decrepitate. If the crystal is a thin film, it may spall off the substrate material.

The reduction reaction may be interrupted before excessive structural damage occurs, however. At this point the crystal may have excessive concentrations and types of undesirable site defects, and the site defects may not have a desired structure. However, exposure of the crystal to a carefully controlled oxidizing environment may remove undesirable defects and generate structurally desirable ones.

The processes by which this can occur are similar to those that occur while the crystal was in a chemically reducing environment. An important difference, however, is that the reoxidation can be made to occur at a different temperature than the reduction reaction. Thus diffusion and site exchange conditions can be significantly different. Furthermore, if a change in oxidation state of a chemical species is involved, the species may diffuse while in one oxidation state and become immobile upon change in oxidation number. This may lead to generation and/or structuring of site defects.

As mentioned above, site defects and site defect structures have important influences on the magnetic properties of oxide crystals. In accordance with the present invention, it has been found that if the crystal is exposed to a carefully controlled oxidizing environment after reduction, it is possible that the defects generated and modified during the reducing treatment can be controlled and impart beneficial properties to magnetic materials. Importantly, it is possible to create and modify site defect structures that cannot be obtained through the crystal growth process alone.

Uniformity Anneal Process Step

As mentioned above, the preferred uniformity anneal step of the present invention is intended to equalize the susceptibility of the film to the changes that occur during the reduction treatment. It is therefore desired for the anneal duration to be long enough such that the oxidative chemical potentials of the magnetic oxide constituent species approach equilibrium with the surroundings during the anneal. [The preferred conditions are those where the temperature is high enough for significant diffusion to occur through the thickness of the film and where the duration is long enough for the oxygen chemical potential to equilibrate with the gas phase. In addition to conditions favoring diffusion, the preferred uniformity anneal conditions also favor rapid oxygen exchange kinetics between the film surface and the anneal gases. In general, the reaction rates that couple the oxygen chemical potential in the film with those in the anneal gases increase with temperature, with the surface area to volume of the film and with oxygen partial pressure.

In general, diffusion is enhanced by elevated temperature, for example, from about 500° to about 1200° C. is an operable range. Moderate temperatures are preferred, from about 550° to about 800° C., since high temperatures can promote film damage. Temperatures in the range of from about 600° to about 700° C. are most preferred. Operable conditions may be found using almost any non-zero oxygen content. However, higher oxygen content is preferred (10% or more) with 100% oxygen most preferred. The higher oxygen content increases the rate of oxygen exchange with the film. Operable, but not preferred, conditions would include oxidative species that decompose under the anneal conditions, for example, ozone. Such chemical species would not favor establishment of an equilibrium between the film and gas ambient oxygen chemical potential. Oxide materials generally withstand high temperatures better under an oxidizing environment.

It is also likely for diffusion to be enhanced if the anneal environment causes significant concentrations of site defects to be present under equilibrium conditions. For example, elevated temperatures may cause a fraction of the oxygen or other atoms in a crystal to move out of lattice sites leaving vacancyinterstitial pairs (Frenkel disorder) and pairs of oppositely charged atoms to move out of their lattice sites leaving pairs of vacancies (Schottky disorder). It is important to stress that under the conditions preferred for enhancing the chemical potential uniformity, these site defects are present under equilibrium conditions.

The concentration of diffusion enhancing equilibrium site defects may also be enhanced by control of the oxidizing or reducing strength of the anneal ambient. This is the case if one of the magnetic oxide constituent species, such as iron, has a multiple of stable oxidation states. If a small fraction of one type of atom is induced to increase its oxidation number then this will introduce vacancies of that species and may significantly increase the diffusion rate of constituent species.

Although high temperatures are favored from the standpoint of requiring shorter anneal durations, additional chemical and physical processes may occur at extreme temperatures that are undesirable. Thus for a given oxide material, there is an optimum range of temperatures over which to conduct the uniformity anneal. These undesired effects include the deposition of particles from the furnace materials, a requirement for more expensive furnace materials of construction, and greater difficulty in achieving sufficient thermal uniformity. Particle deposition is generally undesired because particles may act as nucleation sites for new crystal phases to grow and they introduce locally high concentrations of contaminants.

It is more difficult to control and measure the thermal uniformity of the anneal conditions at higher temperatures. Higher temperatures increase the difference in density between the anneal gas and ambient atmosphere. This may cause hot gas to segregate to the top and cooler gas to segregate to the bottom of the anneal furnace. Non-uniform temperatures may contribute to an undesired temperature gradient in the oxide film under treatment. Temperature gradients are undesired because the relative chemical potentials of the oxide constituents with respect to the ambient gas change slightly with temperature. This may cause non-uniformities to be annealed into the film. The chemical potential uniformity achieved at one temperature may not result in that portion of the film having an identical susceptibility to the reduction treatment as chemical potential uniformity achieved at another temperature.

When determining the optimum anneal conditions of this process for a particular material system, it is important to look for a dependence of the magnetic switching non-uniformities on the orientation of the film during the uniformity anneal. If switching non-uniformities are found to be dependent on film orientation during the uniformity anneal then the anneal conditions must be made more uniform in temperature or ambient gas flow and mixing. These non-uniformities may not be readily detectable until after the film is re-oxidized.

There are various methods by which the proper extent of the uniformity anneal can be determined and monitored as part of this process step. Ultimately, the desired objective is uniform susceptibility of the oxide film to the reduction and reoxidation treatments. The switching uniformity of the film prior to the uniformity anneal should be assessed and any non-uniformities noted. Because the uniformity anneal is likely to change the magnetic properties significantly, it may not be possible to assess the post-reoxidation switching uniformity immediately following the uniformity anneal. However, if such an assessment is possible, then the extent (time, temperature) of the uniformity anneal should be severe enough such that any non-uniformity observed prior to the uniformity anneal is not detected. In general, sensitive detection of switching non-uniformity may have to wait until the film has undergone the reduction and re-oxidation treatments.

It is therefore important to keep track of the location and patterns of non-uniform switching prior to the uniformity treatment. If a similar pattern should be observed after the reduction and re-oxidation treatments, this indicates the uniformity anneal process should be more severe. Higher temperatures, longer durations, or possibly alternate anneal gas compositions will serve to correct the situation.

For example, an as-grown film was subjected to a uniformity anneal (6.5 hr. in 100% $O_2$ at 520° C.). It then went through a reduction anneal (8% $N_2$, 15% $H_2$ gas mixture for 5 minutes and 50 seconds at 490° C.). After 20 minutes of re-oxidation anneal (580° C., 100% $O_2$) it was noted the central portion of the wafer switched at lower fields than the edges. The film was then annealed for 24 hours at 580° C. in 100% $O_2$. This removed the non-uniformity and, upon subsequent reduction and re-oxidation, a uniformly switching film was obtained.

Uniformity anneals as severe as 9 days, 700° C. 100% $O_2$ have been successfully utilized. However, increased domain pinning defects are associated with long high temperature treatments. Although such defects may or may not be beneficial for some applications, once introduced, they cannot be removed from a film.

In addition to the risk of introducing pinning defects, the switching field also increases with uniformity anneal temperature and duration. The duration of the subsequent reduction anneal can be lengthened slightly to compensate, for example, 7 minutes in 85% $N_2$, 15% $N_2$ at 490° C. instead of 6 minutes.

The switching uniformity may be assessed for magneto-optic materials by placing the material between crossed linear polarizers and observing the domain pattern of the film magnetization. A uniform magnetic field is then applied normal to the film, for example by using a Helmholtz coil configuration or by other means. The magnetic field is then slowly increased and domain movement observed. In a uniformly switching film, the domains will move roughly equal amounts in all areas of the film. In non-uniform films, some locations will switch magnetization state at lower fields than other locations. This test should be repeated several times with the domains arranged in different patterns prior to testing. If the film possesses domain pinning sites, such as from dislocations, then these should be noted and their influence on domain wall motion not considered when assessing uniformity. It is often convenient to photograph the domain pattern to form a record of any non-uniformities for subsequent comparison with the uniformity the film after it has undergone treatment.

For non-magneto-optic materials, other means can be devised to assess switching uniformity. For example, instead of visualizing domains by their rotation of polarized light, one can measure the magnetization using a scanning Hall effect probe or by using a scanning magnetoresistive probe.

Still other methods may be used to monitor the effectiveness of the uniformity anneal process step. For example, the optical transmission or absorption of the film may be measured and through prior experience optical non-uniformities may be related to subsequent switching uniformity performance after reoxidation.

As noted, conditions favoring diffusion are preferred for enhancing the chemical potential uniformity of magnetic oxide films. These conditions include elevated temperature and control of the anneal gas oxidative strength. Criteria are presented that apply to any magnetic oxide material system for determining if the anneal conditions are sufficient. Criteria are also presented for determining the trade-off considerations between anneal temperature and anneal time process variables. By following these suggestions, it is possible to fine-tune the uniformity anneal process to modify as-grown material into a form which has sufficient chemical potential uniformity to react uniformly in the subsequent reduction treatment. Where, however, as-grown material is sufficiently uniform in the chemical potentials of its constituent species, a uniformity anneal process step is not required.

Reduction Treatment Process Step

The goal of the reduction treatment step of the process is to cause chemical and physical changes in the magnetic oxide film such that when the film is re-oxidized, new and possibly otherwise unobtainable material phases and structures are obtained. It is impossible to enumerate all of the physical property changes which this process may cause to occur. However, this process is believed to modify as-grown and previously annealed material with possibly beneficial modifications to coercivity, optical absorption, Faraday rotation, magnetic anisotropy, switching field, magnetic hysteresis, magnetization, and the temperature stability of these properties.

It is believed that the reduction treatment introduces site defects which allow partial re-arrangement of the ions in the film crystal. These site defects are introduced due to the change in oxidation state of one or more of the magnetic oxide constituent chemical species. The conditions under which the reduction treatment is conducted to induce the partial site rearrangement are outlined below.

There are three fundamental process variables that determine the physical and chemical changes in a material undergoing treatment. These are temperature, duration, and reductive strength of the process gas. The goal in implementing this process is to find the combination of these three anneal conditions that induce the desired changes in the material upon its re-oxidation while at the same time limiting the extent of the undesired changes. The reduction/re-oxidation process has many applications and what constitutes a beneficial change in one material system for one application may be considered undesirable for another. Thus the process is disclosed here in terms of changes that are induced in the material undergoing treatment and how the three process variables can be modified to adjust the process for a particular desired effect.

Unlike the uniformity anneal process step discussed above, the reduction treatment is carried out under non-equilibrium conditions. The reduction anneal must be halted while the film is still undergoing significant change. Thus, control of the temperature, duration and gas composition of this step are critical in providing material that has film-to-film consistency for use as feedstock in the subsequent re-oxidation step of the process.

Effect of treatment conditions

Small changes in temperature have a profound influence on the rate of chemical reactions. Since the reduction anneal step is halted before the reactions involved are completed, the temperature of the anneal has a strong influence on the time required for the desired chemical and physical changes to be completed and also on the time before undesired changes become too severe.

The relative rates of two chemical/physical processes have primary influence on the outcome of the anneal. These are the diffusion rate of reacting species and the rate of the chemical reduction reaction itself. Both of these processes have characteristic activation energies. If the activation energies of these process are appreciably different, then it may be possible to favor one process over the other by conducting the reduction process step at a particular temperature. It is not necessary to know the precise kinetic mechanism of the reduction reaction in order to control this step of the process. One may achieve well defined and desirable results by following the protocol presented here.

Table I shows how the three process variables can affect the relative rates of the diffusion and reaction rates. When site rearrangement is the desired outcome of the treatment, then diffusion within the film is desired. In general, activation energies for chemical reactions tend to be greater than those for diffusion. Therefore it is usually desirable to conduct the reduction process at lower temperatures when site rearrangement is desired.

TABLE I

Process conditions and direction to modify a particular condition to favor site re-arrangement over physical changes.

| Desired Effect | Temperature | Duration | Gas Reactivity |
|---|---|---|---|
| site re-arrangement | lower | longer | lower |
| physical structuring | higher | shorter | higher |
| uniformity | higher | shorter | higher |

The effect of anneal duration on the desirability of the reduction anneal outcome is critical but complex. The optimum duration for the reduction anneal can be expected to be dependent on the material system undergoing treatment.

In practice, for a particular furnace configuration, there is a practical minimum for the duration of an anneal. This duration may be on the order of a few seconds in the case of a rapid thermal process furnace where the time is limited by the thermal shock resistance of the film substrate. The minimum anneal time may be several minutes in the case of a constant temperature furnace where the minimum effective anneal duration is limited by thermal exchange between the film and the furnace.

It is to be emphasized that the reduction anneal is carried out under non-equilibrium conditions. These conditions will likely cause the disruption of the crystal if the anneal duration is too long. The non-equilibrium nature of the anneal is an essential aspect. Thus long duration anneals (several hours) may be insufficiently far from equilibrium conditions to cause the combination of stress, chemical potential gradients, and favorable reaction kinetics to produce optimum results.

The physical and chemical changes occur more uniformly when the reaction is limited by diffusion processes. Thus higher temperatures and more reactive gas ambient are favored. These conditions also increase the reaction rate.

When implementing this process, a means for starting and stopping the reaction quickly and uniformly should be provided. This may be done by a rapid change in gas ambient but may also be done by a rapid but uniform change in the film temperature of a few tens of degrees Centigrade.

The reductive strength of the anneal gas may be modified in three ways. First, the chemically reducing species of the gas may be selected according to its affinity for reacting with the material undergoing treatment. Examples of candidate reducing gases are hydrogen, carbon monoxide, methane, ethylene, acetylene, etc. Since this process pertains to oxide materials, inert gases such as argon, nitrogen, and even a vacuum may also be considered reducing provided the temperature of the treatment is sufficiently high. The reducing strength of these gases may be modified by mixing with each other. The reducing strength may also be lessened by mixing with other gases that are products of chemical reactions during the anneal or that exist in equilibrium with small concentrations of oxygen. For example, the addition of small amounts of water vapor to hydrogen greatly lessens the reducing strength.

Control Criteria

The properties of the re-oxidized film depend on the extent or degree of the changes that occur during the reduction anneal. Therefore it is desirable to monitor the reduction anneal process so that small changes in the anneal conditions can be corrected or compensated for. The high degree of sensitivity of the extent of the film reduction to process conditions, particularly temperature, and to prior treatment of the film presents several challenges with respect to control of the process. Monitoring and control of the anneal conditions is an essential aspect of implementing the present invention.

Once the proper conditions of temperature and gas ambient are provided, the extent of the reduction should be monitored by measurement of one or more properties of the film being annealed. Properties that can indicate the extent of the reduction reaction include optical reflectance, optical absorption, film lattice constant, microwave reflectance, electrical conductivity, and various magnetic properties.

It is preferable to measure one or more of these properties concurrently with the anneal of the film. The duration of the anneal is then controlled (lengthened or shortened) so that the measured property is within a certain range of values at the conclusion of the reduction anneal. This range of values is determined from prior experience of what produces satisfactory results after re-oxidation. In this scheme, the temperature and anneal gas composition are held as constant as practical. Only the duration of the anneal is adjusted to compensate for unintended changes in process conditions.

Alternately, one could attempt to maintain very tight control of temperature, gas composition, and anneal duration. At the conclusion of the reduction anneal step the film properties can be measured and the results used to modify any one of temperature, duration, and gas composition for the subsequent reduction anneal. This scheme is not preferred because of significant variation in film-to-film susceptibility to the reduction treatment and because of difficulty in controlling the temperature of the anneal with sufficient accuracy.

Re-oxidation Process Step

The final step in the process for inducing desirable magnetic properties is to re-oxidize the partially reduced film. The physical and chemical processes that occur are similar to those described for the reduction step of the process.

Oxide materials are significantly more chemically stable under oxidizing conditions then under reducing conditions. The oxide film also exhibits higher optical transmission when close to being fully oxidized. Furthermore, the desired magnetic properties will usually, but not necessarily always, be obtained when the magnetic film is nearly fully oxidized. For these reasons, it is desirable to control the extent and degree of the changes induced by the reduction and re-oxidation process by controlling the extent of the reduction reaction. The reoxidation step is then conducted to cause nearly complete oxidation. However, the temperature, gas ambient, and duration of the re-oxidation step also influence the magnitude of the changes. It is believed that diffusion processes occurring while the film is in a partially reduced state are responsible for the desirable changes.

Examples of gas ambient that can be used are oxygen, nitrogen oxides, ozone and dilutions and mixtures of these gases with inert gases such as argon, nitrogen, and steam. It is preferable to use oxygen and mixtures of oxygen with inert gases rather than unstable gases such as ozone.

Although ozone can increase the oxidation rare and possibly promote desired non-equilibrium structuring, ozone also decomposes readily at the temperatures of the anneal. This can cause different regions of the film undergoing treatment to be exposed to different concentrations of ozone and thereby affect the film properties nonuniformly. High optical transparency is favored by a weaker oxidizing strength of the gas ambient.

As the film becomes more fully oxidized, the reaction rate diminishes. In implementing this process, this characteristic may be beneficially utilized as described below. First, the progressively slower changes permit and allow for fine control of the magnetic properties of the film. One periodically removes the film from the anneal conditions and measures indicator properties such as switching field, coercivity, and magnetic anisotropy. On the basis of these measurements and prior experience, the film is subsequently annealed under possibly different conditions of temperature, duration, and gas ambient. By following this procedure, it is possible to compensate for variability in the starting material and to compensate for small variations in the reduction step conditions and produce a highly film-to-film consistent product.

A benefit, in addition to fine control of film properties, may also be obtained by controlling the gross extent of the induced changes through the extent of the reduction step. As the rate of property changes slow down during re-oxidation, the sensitivity of the film to variation in temperature and gas composition diminishes. Thus, the thermal and gas composition uniformity are less critical for this scheme than if the reoxidation is suspended before it approaches completion.

It has been noted that the reduction/re-oxidation process may cause non-equilibrium structures and atomic arrangements to develop. Continued oxidative annealing of a film will cause the film to approach an equilibrium state. In general, the rate of the re-oxidation reaction toward a non-equilibrium configuration and the rate of changes toward the equilibrium configuration will depend on the temperature and gas ambient conditions of the anneal. The relative rates of these reactions can be influenced by changes in the gas composition and temperature.

The relationship of the relative rates of these reactions to the process conditions may be complex. For example, as discussed above, diffusion will be enhanced in the presence of ion and oxygen vacancies. As re-oxidation progresses, the diffusion rate may slow down, and there may be considerable variation in strain through the thickness of the film. This may influence the atomic arrangement of ions in the crystal which in turn affects the magnetic properties.

Two important aspects of the reduction/re-oxidation process invention described here are that to some extent the changes in magnetic properties are reversible (some changes can be undone by long duration anneals at high temperature) and that the changes can also be cumulative. Successive applications of the reduction/re-oxidation cause incremental shifts in the magnetic properties. It is possible to obtain, for example, a lower magnetic anisotropy by two successive reduction/re-oxidation cycles than is readily obtained via one cycle. This is because the extent of the reduction required to obtain the changes in one cycle would result in excessive disruption of the crystalline structure.

Example I

The process of the present invention has been used to induce desirable changes and control of the switching characteristics of a bismuth-thulium garnet magneto optic film. The growth of this starting material by liquid phase epitaxy is described by U.S. Pat. No. 4,544,239. After reduction/re-oxidation processing, the film exhibits sufficient switching uniformity and sensitivity to be used for the eddy current imaging of cracks, such as in the invention described by U.S. Pat. Nos. 4,625,167 and 4,755,752.

The process conditions found to work best for this application are to conduct a uniformity anneal at 600° C. for 5 hours in a pure oxygen ambient. Films with unusually severe switching non-uniformities may be annealed for longer times and at higher temperatures, or both, for example 700° C. and 24 hours.

Subsequently, the film is reduced in a 15% hydrogen, 85% nitrogen gas mixture for approximately 10 minutes at a temperature of approximately 480° C. This step is extremely sensitive to temperature. The film is rotated inside the furnace in order to subject the film to a sufficiently uniform thermal environment. The wafer is generally visually observed during the anneal and is removed promptly when the film begins to darken appreciably. The film undergoes a shift in lattice constant of about 0.006 Angstroms in compression as a result of the reduction treatment. The reduced film may exhibit a high coercivity at room temperature with field of 20 oersteds or more required for switching.

The film is then re-oxidized in a 100% oxygen atmosphere at a temperature of about 600° C. for a total duration of about 30 minutes. Generally, the film is re-oxidized in small increments so as to ensure tight control of the final properties. After about 6 minutes of oxidation, the film rotates polarized light in the opposite sense exhibited by the as-grown material for a given direction of magnetization (Faraday reversal). The coercivity may still be high, 4 to 20 oersteds. The lattice constant has begun to shift back about half way toward the as-grown value. After about 16 minutes of re-oxidation, the lattice constant shifts slightly more toward the as-grown value but the magnetic field required for switching drops significantly to about 1.5 oersteds for 50% of the film to switch. Continued re-oxidation continues to lower the field required for switching and the lattice constant approaches the as-grown value.

Eventually, continued oxidative annealing causes the switching field to increase. This is used to advantage in producing material with a tightly specified switching field. Using prior experience, one carries out the reduction step to achieve a particular degree of darkening so that upon re-oxidation, the switching filed approaches a minimum slightly lower than the desired value. One then adjusts the time of the re-oxidation anneal to obtain the desired switching field while the switching field is still decreasing with anneal time. If the desired stop point is overshot, resulting in a too low switching field, then the re-oxidation anneals are continued. The switching field will begin to increase after about fifty minutes total duration of the re-oxidation anneal. One then periodically measures the switching field and stops the anneal when the desired value is obtained.

The film may be subjected to the reducing and re-oxidation treatments several times until the precise switching characteristics are obtained.

Comparative Example II

A 3 μm thick film is grown from a 3 kg melt containing the following oxides expressed in weight percent.

| | |
|---|---|
| PbO | 66.19 |
| $Bi_2O_3$ | 27.29 |
| $Fe_2O_3$ | 4.70 |
| $Ga_2O_3$ | 1.02 |
| $V_2O_5$ | 0.45 |
| $Tm_2O_3$ | 0.35 |

The melt is contained in a platinum crucible and initially held at 1000° C. to make sure all the oxides are in solution. The melt is then cooled to 730° C. and a cleaned substrate is horizontally dipped into the melt supported by a platinum holder. The substrate is GGG cut from a boule, polished on (111) faces. so that the final surfaces contain less than 2 defects/$cm^2$. The cleaned substrate is a polished GGG wafer which exhibits no scratches or subsurface damage when observed by light microscopy at 200X after etching. The substrate is prepared for examination by etching for 2 min in 160° C. phosphoric acid to expose defects and residual polishing damage. The substrate is rotated back and forth at 100 rpm reversing rotation direction every five seconds for eight minutes. The film is then pulled out of the melt and the residual melt materials removed by spinning the film horizontally at 300 rpm for five seconds. The film is slowly pulled out of the furnace 5–10 minutes and soaked in 80° C. glacial acetic acid to remove the last traces of flux (5–30 minutes). The reverse side of the film is polished off using colloidal silica and commercially available wafer polishing machine and templates.

The monocrystalline ferromagnetic oxide film may be annealed in an oxidizing environment to modify the as-grown low coercivity level that is characteristic of the as-grown film. The purpose of oxygen anneal is to provide a readily switchable film having a good square shaped hysteresis loop.

The film is subjected to a 1050° C. anneal in flowing 0.2 μm filtered oxygen will provide a film that is readily switchable and having a substantially square shaped hysteresis loop in 50 minutes. The length of time the film is in the furnace at the annealing temperature is rather critical with an available anneal window of about five minutes. Under-annealed film will exhibit areas which do not switch. Such under-annealed film can be reclaimed by a further 5–10 minute anneal at 1050° C. If, however, a film is over-annealed, the film will switch well but the contrast when viewed through crossed polarizers will be less than adequate. The film in this latter state cannot be reclaimed by further annealing.

The monocrystalline ferromagnetic film may also be annealed utilizing the two-step annealing method of the present invention as follows:

Anneal (uniformity anneal) in 100% $O_2$ for 5 hours at 600° C.

Anneal in 15% $H_2$, 85% $N_2$ at 450° C. for 10 minutes or until the film transmission falls by 50%.

Anneal in 100% $O_2$ at 600° C. in 20 minute intervals and test for desired switching performance or domain size.

What is remarkable is that use of the optimal uniformity anneal step and the two-step method of annealing of the present invention allows any over-annealed film to be recovered. Whereas the changes imparted by oxygen anneal alone are irreversible, the changes imparted by the two-step process of the present invention are reversible. Adjustment is achieved by repeating the sequence of annealing at reduction conditions followed by annealing at oxidation conditions.

This attribute of reversibility acquired where the two-step method of the present invention is used to adjust properties of the magneto-optic film is not the only change observed where the method of the present invention is used. Yet another remarkable change in the film characteristics is that the film has a reverse sense of Faraday rotation when contrasted with the Faraday rotation of the film annealed utilizing only oxygen anneal.

Thus, where the oxygen anneal step of the two-step method of the present invention previously described is unduly prolonged, for example 60 minutes in 100% $O_2$ at 600° C. which results in an equilibrium domain size of 3 to 4 mm instead of the desired 1 mm range, the film is first treated by anneal in 15% $H_2$, 85% $N_2$ at 490° C. for 5 minutes. Occasionally such reduction treatment is sufficient to affect the domain size and switching characteristics sufficiently and bring them to the desired ranges. However, usually re-oxidation is required. If only a small adjustment in property is needed, as in this example, then only several minutes (3 to 5) are generally necessary. If testing after 5 minutes shows the film properties such as domain size and switching field to be changed in a direction away from the desired properties, then additional reduction treatment, as described above, is called for. As long as the property changes are toward the desired result, then continued re-oxidation is called for.

In this manner, one can gently decrease the domain size through reduction and re-oxidation cycles of short duration. Increased domain size is obtained by a long re-oxidation anneal (generally 50 minutes or longer).

Thus, when the target domain size desired is a 1 mm domain size, it is possible to obtain the desired range with high precision and with a controllable rate of approach. Overshot errors are easily corrected through longer re-oxidation or cycles of reduction and re-oxidation.

Where, prior to annealing in accordance with the present invention, the as-grown film of the present invention is treated using optimal uniformity anneal, the switching uniformity of the final product is enhanced. Additionally, the reduction/re-oxidation process affords fine and reversible control of film properties such as switching field and domain size. Although control of these same properties may be affected through changed conditions of film growth by LPE, for example, growth temperature, film growth is complex and other film properties, such as thickness, may be inadvertently affected.

Utilization of the present invention allows one to optimize the complex growth process for one set of conditions and yet manufacture films with a range of properties. The reversible nature of this process results in a high yield, enabling essentially every film processed to achieve the desired properties. Furthermore, the process is highly controllable in that the rate of property evolution may be diminished as the desired endpoint is approached.

EXAMPLE III

This example illustrates the two-step anneal method of the present invention preceded by the highly preferred embodiment of the present invention, which includes uniformity anneal.

Uniformity Anneal

The wafer of comparative Example I is annealed for one or two hours in 100% oxygen at 670° C. Annealing in 100% oxygen at a lower temperature, e.g., 580° C. for longer times (four to six hours) is also effective in removing less severe switching non-uniformities. Ozone may also be added to the oxygen for the 580° C. anneal. A four inch diameter, three zone tube furnace is used. The wafers are held perpendicular to the tube axis by a quartz carrier. The wafer carrier slides into and out of the middle zone in about two minutes.

This anneal alters the magnetic properties of an as-grown (Faraday normal) film by raising the switching field and by making it more uniform. It also alters the magnetic properties of a Faraday inverted film by increasing the switching field and making it more uniform. The extent of the increase in switching field may vary from film to film. The change is usually from 2.0 before to 5.0 Oe after a 6 hour anneal at 600° C. in 100% $O_2$. The uniformity in switching does not appear to be affected by this anneal if there was no variation in the switching field with location on the wafer prior to the anneal. The initial and final switching fields do not appear critical, since films with initial and final values of 20 and 100 Oe have been observed and, by means of the reduction/re-oxidation process, made to switch at low fields (0.8 Oe) and exhibit the desired 1 mm domain size. In the case of an as-grown film with an initial switching field of 2.0 Oe and exhibiting undesirable variation in switching, for example 1.9 to 2.1 Oe in different locations of the film, this variation can be reduced as a result of a 6 hour anneal at 600° C. in 100% $O_2$ to the level of 5.0 to 5.1 Oe switching across the film.

After undergoing the uniformity anneal, the film is evaluated to see if re-treatment with a uniformity anneal is needed. This evaluation is performed by placing the wafer approximately 4 inches above a 6 inch diameter coil of wire and passing a current through the coil. The magnetic field generated causes the domain walls to move. The uniformity of this motion is observed by passing linearly polarized light through the film and then through a linear polarizer to the observer. The magnetic field required for switching can be measured with a Hall effect probe placed adjacent to the film, but it is usually only necessary to determine if there is observable variation in the extent of domain wall motion across the film. In particular, the switching field at any point should not depend on location on the wafer, that is, there should be uniformity. If variation on domain wall motion is observed as the magnetic field generated by the coil is increased, then further annealing is desirable. It has been found helpful to increase the temperature and/or the duration of the immediately subsequent uniformity anneal, if one is required as a result of the testing and evaluation explained above. For example, after an as-grown film is annealed in 100% $O_2$ for 6 hours at 600° C. and subsequent evaluation shows that one region switches at 6.5 Oe instead of 6.0 Oe for the rest of the film, then a further anneal in 100% $O_2$ for 6 hours at 700° C. is performed. The film should be retested and if a non-uniformity still persists, then an anneal in 100% $O_2$ for 24 hours at 700° C. is performed. Only in exceptional cases do the conditions just described fail to make the switching properties uniform and adequately prepare the film for the reduction/re-oxidation process.

Hydrogen Anneal

The wafer is hydrogen annealed at 480° C. in an 85% nitrogen, 15% hydrogen atmosphere. The anneal duration can vary depending on the prior treatment of the sample. Films that have been oxidized at high temperatures, for example 700° C., for long times, for example 24 hours, and Faraday normal films require longer durations, typically about twelve minutes suffices. Films that are developed to the point where they have a switching field less than 4 Oe require shorter treatment times, suitably about three to ten minutes being sufficient.

In order to preserve uniformity of the switching field, it is important that the temperature of the wafer be uniform during the anneal. One way of accomplishing this is by suspending the wafer from a long shaft and rotating it between baffles inside a tube furnace. Thermal uniformity of about 1° C. or less across the film is believed to achieve the best results, though variations outside this range may be used, albeit not necessarily with the same results.

Films may be evaluated after the hydrogen anneal by examining the color of the film. A successful hydrogen anneal produces films with a uniform darker, but not black, color. Dark brown is about right. Films can also be characterized by X-rays to determine their compression. The compression present in as-grown films is controlled through the conditions of film growth. The degree of compression has considerable influence on the magnetic anisotropy of the film and on the switching characteristics through the magnetostrictive properties of the film. Thus, the properties of as-grown films can be controlled by varying the extent of film compression by changing the conditions of film growth.

The degree of compression is modified as a result of the reduction and re-oxidation treatments relative to the amount initially present in the film. This relative change for the reduction anneal is about a 0.009 Å increase in film compression and does not seem to depend on the initial, i.e., as-grown, compression present. Furthermore, during the course of the reduction treatment, the compression increases up to about 0.009 Å relative to the as-grown value and does not increase beyond this value if the anneal is continued. However, at the point this maximum in film compression is attained, the film begins to darken.

Although the degree of compression initially present in a film (as-grown) affects the as-grown properties, the degree of compression initially present is not important in the final properties attained through the reduction/re-oxidation process. This is because the range of properties (domain size, anisotropy, switching field, etc.) can be controlled beyond the range attainable through practical levels of as-grown film compression.

Oxidizing Anneal

The wafer is then oxidation annealed at 580° C. in an oxygen and/or ozone atmosphere. As with the uniformity anneal, a tube furnace and quartz wafer carrier are used. The anneal duration is typically between five minutes and one hour. Before the anneal, films are evaluated. A gross evaluation is performed by placing the film 4" above a 6" diameter electromagnet and observing the switching state of film with transmitted light through crossed polarizers on either side of the film. Current is passed through the electromagnet and, by means of a Hall effect probe, the fields required to initiate switching, cause 50% switching, and cause complete switching are measured. For films that have just completed a first reduction anneal, these fields typically range from (3.0, 4.4, 5.1 Oe) to (10, >100, >100 Oe). This evaluation is not a necessary part of the process. The film of the present Example, after the first reduction anneal, when treated at least 30 minutes at re-oxidation anneal in 100% $O_2$ at about 600° C., generally is satisfactory.

However, films that have previously been through a reduction/re-oxidation cycle may have switching characteristics close to the desired range (50% switching point between 0.6 and 2.0 Oe). In such cases, and when evaluation following a re-oxidation anneal shows the film to be in this range, it is desirable to evaluate the film for the crack detector application in the crack detector instrument. Films for other applications that would advantageously utilize the fine-tuning capabilities of this manufacturing process should also be tested in a special purpose apparatus.

The operation of crack detector instruments is complex, and not germane to the reduction/re-oxidation process described here. It is included in this discussion for the purpose of illustrating how special purpose and end-use specific instrumentation may be required to fully utilize the fine control of magnetic film properties afforded by this process. Significant changes in film performance in the crack detector occur for small (less than 0.1 Oe) changes in the film switching characteristics.

As part of the film evaluation procedures using this end-use specific instrument, test plates are examined with the wafer under test loaded in the instrument. Based on the appearance of images generated by the crack detector instrument and prior experience with how these images changes as a result of film reoxidation, a history was developed. This history allows, to some degree, one to predict the effect of subsequent anneal treatments on the performance of a film in the crack detector.

There remains a significant degree of film to film variability with respect to evolution of properties during the anneals when measured in terms of performance in the crack detector. This is due to the high sensitivity of film performance for this application and due to small, and as yet uncontrolled variations in film preparation.

The detailed description set forth is the preferred embodiment of the method of the present invention. However, certain changes may be made in carrying out the above method without departing from the scope of the invention; it is therefore intended that all matter contained in the above description shall be interpreted as illustrative and not in a limited sense. It is also to be understood that the following claims are intended to cover all of the generic and specific features of the invention herein described, and all statements of the scope of the invention which, as a matter of language, might be said to fall therebetween.

We claim:

1. A method for adjusting the magnetic properties of an iron containing monocrystalline magneto-optic bismuth iron garnet film which comprises:

(a) annealing said film at reduction conditions; and then (b) annealing said film at oxidation conditions.

2. The method of claim 1, wherein steps (a) and (b) are repeated.

3. The method of claim 2, wherein steps (a) and (b) are repeated a plurality of times.

4. The method of claim 1, wherein the bismuth iron garnet film is a rare earth substituted bismuth iron garnet film.

5. The method of claim 1, wherein step (a) is preceded by a uniformity anneal step at oxidation conditions.

6. The method of claim 5, wherein steps (a) and (b) are repeated.

7. The method of claim 6, wherein steps (a) and (b) are repeated a plurality of times.

8. The method of claim 1, wherein steps (a) and (b) are repeated.

9. The method of claim 8, wherein steps (a) and (b) are repeated a plurality of times.

10. A method for adjusting the magnetic properties of an iron containing monocrystalline magneto-optic film which comprises:

(a) first subjecting said film to a uniformity anneal step at oxidation conditions; then (b) annealing said film at reduction conditions; and then (c) annealing said film at oxidation conditions.

11. A method for adjusting the magnetic properties of an iron containing monocrystalline magneto-optic film of the following generic formula:

$$Bi_xRE_{3-x}Fe_{5-y}Ga_yO_{12}$$

where RE represents a rare earth, or combination of rare earths or Y or combination of Y with one or more rare earths; x=0 to 3 and y is greater than zero and less than five which comprises:

(a) annealing said film at reduction conditions; and then (b) annealing said film at oxidation conditions.

12. The method of claim 11, wherein step (a) is preceded by a uniformity anneal step at oxidation conditions.

13. The method of claim 12, wherein steps (a) and (b) are repeated.

14. The method of claim 13, wherein steps (a) and (b) are repeated a plurality of times.

15. The method of claim 11, wherein steps (a) and (b) are repeated.

16. The method of claim 15, wherein steps (a) and (b) are repeated a plurality of times.

* * * * *